US005326038A

United States Patent [19]

Nilsson

[11] Patent Number: 5,326,038

[45] Date of Patent: Jul. 5, 1994

[54] BEATING APPARATUS FOR FIBER SUSPENSIONS

[76] Inventor: Harry Nilsson, Hauptstrasse 58, CH-8274-Tägerwilen, Switzerland

[21] Appl. No.: 955,867

[22] PCT Filed: Apr. 10, 1992

[86] PCT No.: PCT/SE92/00237

§ 371 Date: Dec. 9, 1992

§ 102(e) Date: Dec. 9, 1992

[87] PCT Pub. No.: WO92/18691

PCT Pub. Date: Oct. 29, 1992

[30] Foreign Application Priority Data

Apr. 12, 1991 [SE] Sweden ..... 9101114-8

[51] Int. Cl.[5] ..... B02C 19/00

[52] U.S. Cl. ..... 241/74; 241/86.1; 241/89.3; 241/95

[58] Field of Search ..... 241/74, 85, 91, 89.3, 241/86.1, 95; 209/273, 373, 397, 399

[56] References Cited

U.S. PATENT DOCUMENTS

| | | | |
|---|---|---|---|
| 2,980,350 | 4/1961 | Lejeune | 241/73 |
| 3,138,336 | 6/1964 | Lejeune et al. | 241/74 X |
| 3,615,058 | 10/1971 | Nilsson | 241/85 |
| 4,674,251 | 6/1987 | Wolff | 209/399 X |
| 4,955,549 | 9/1990 | Reinhall | 241/89.3 X |

FOREIGN PATENT DOCUMENTS

| | | | |
|---|---|---|---|
| 71362 | 3/1916 | Austria | 209/399 |
| 213898 | 10/1909 | Fed. Rep. of Germany | 241/91 |
| 3700613 | 6/1988 | Fed. Rep. of Germany . | |
| 0307504 | 1/1969 | Sweden . | |
| 918366 | 4/1982 | U.S.S.R. | 241/85 |

*Primary Examiner*—Timothy V. Eley
*Assistant Examiner*—Frances Han
*Attorney, Agent, or Firm*—Quarles & Brady

[57] ABSTRACT

A beating apparatus for fibre suspensions, including a housing having at least one inlet for suspension and one outlet for beaten suspension, a rotor rotatably arranged in the housing and having a beating surface, in which open perforations extend through the rotor, and at least one stator arranged in the housing and having a stator shoe located close to the beating surface of the rotor is provided. In order to prevent unbeaten suspension from reaching the outlet, shields and guides are provided between the inlet and the outlet. The shield and guides lead all flow between the inlet and the outlet through the stator shield.

5 Claims, 11 Drawing Sheets

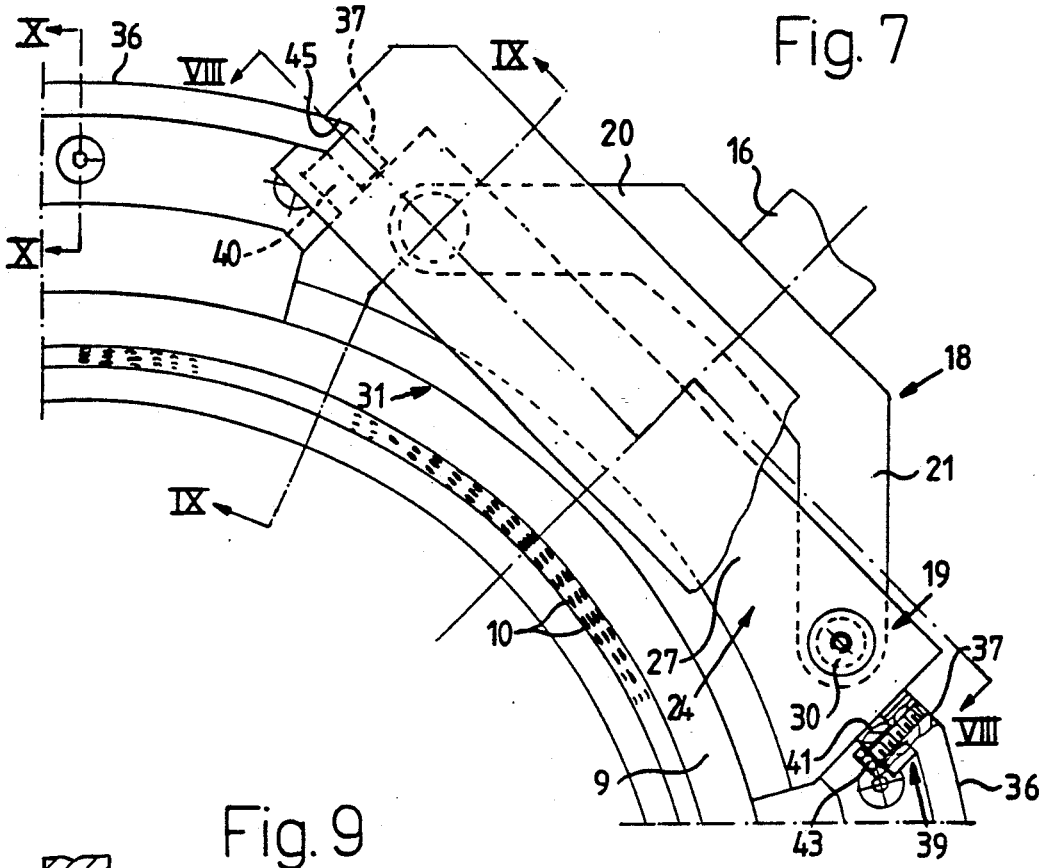
Fig. 7
Fig. 9
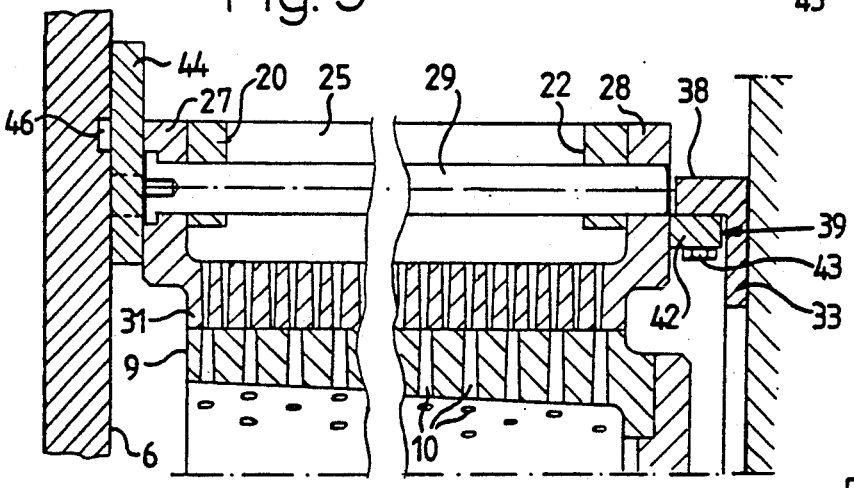
Fig. 10
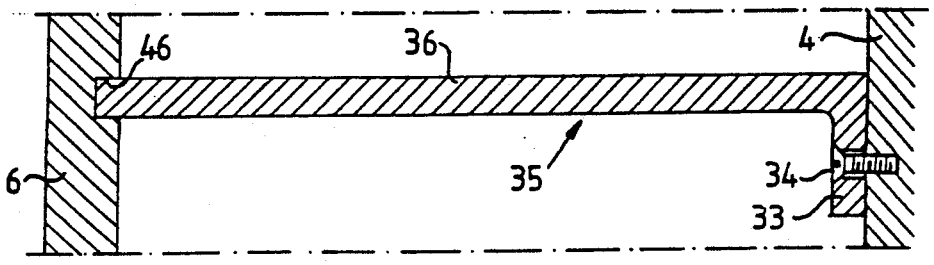

BEATING APPARATUS FOR FIBER SUSPENSIONS

FIELD OF THE INVENTION

The present invention concerns a beating apparatus for fibre suspensions, including a housing having at least one inlet for suspension and one outlet for beaten suspension, a rotor rotatably arranged in the housing and having a beating surface, in which opens perforations extending through the rotor, and at least one stator arranged in the housing and having a perforated stator shoe located close to the beating surface of the rotor.

BACKGROUND OF THE INVENTION

Such a beating apparatus is known from SE-B-307 504, wherein the rotor is a drum, the inlet for suspension opens into the drum, a plurality of stator shoes is arranged at the outer periphery of the drum and a space outside the drum communicates with the outlet. The drum is open towards the inlet and a stationary distributor drum is inserted in the drum to direct incoming flow of suspension towards predetermined locations of the internal periphery of the drum, viz., those locations located in the beginning, as counted in the rotational direction of the drum, of the stator shoes arranged at the outer periphery of the drum. From strength reasons, however, a drum for a beating apparatus of this kind must be provided with a relatively thick envelope wall. This, in turn, results in that the perforations of the envelope wall become so extended in the radial direction that the passage time for a fibre from entering a perforation until leaving it may be so long that the fibre leaves a perforation only after it has passed a stator shoe, i.e., between two stator shoes, which results in that the unbeaten fibres mixes outside the rotor with beaten fibres having passed through the stator shoes. This, of course, results in an insufficient beating of the suspension.

SUMMARY OF THE INVENTION

The object of the present invention is to set aside this drawback of beating apparatuses of the kind initially stated, such that only beaten suspension reaches the outlet. In achieving this the rotor can be a drum shaped as well as disk shaped rotor.

The invention is based on the idea of providing means between the inlet and the outlet adapted to prevent flow of unbeaten suspension to the outlet by leading all flow between the inlet and the outlet through the stator shoe.

Expressed in another way it may be said that said means together with the stator shoe shall divide the housing in two parts substantially liquid tightly separated from each other (except for flow through the stator shoe), of which one part shall have communication with the inlet and the other part with the outlet. Flow between the inlet and the outlet, thus, can only take place through the stator shoe.

Expressed in yet another way it can be said that the rotor as a whole and one surface of the stator shoe shall be located in one part while the other surface on the stator shoe shall be located in the other part.

Consequently, the invention is mainly caracterized in that between the inlet and the outlet is provided shield and guide means which together with the stator shoes divides the housing in two parts substantially liquid tightly separated from each other, of which one part communicates with the inlet and the other part communicates with the outlet, said rotor as a whole and one surface of the stator shoe being located in one part, while the other surface of the stator shoe is located in the other part, such that flow between the inlet and the outlet can take place only through the perforations of the stator shoe.

In case of a beating apparatus, in which the rotor is a drum, the envelope surface of which is at least partly perforated, the inlet opens in the drum, a stator shoe is arranged at the outer periphery of the drum and a space outside the drum communicates with the outlet, the object of the invention is achieved in that the flow of beaten suspension from the perforations of the stator shoe is separated from the flow of unbeaten suspension transported through the perforations of the drum in that said shield and guide means is arranged in said space between the stator shoe and the housing to lead the beaten suspension to the outlet without contact with unbeaten suspension. Unbeaten suspension is returned to the interior of the drum.

In case the rotor is a drum the envelope surface of which is at least partly perforated, the inlet opens in the drum, the stator shoe is arranged at the inner periphery of the drum and a space radially outside the drum communicates with the outlet, said object is achieved in that said shield and guide means is arranged between the inlet and the stator shoe to lead suspension directly from the inlet to the perforations of the stator shoe. Hereby is assured that all incoming unbeaten suspension is lead through the perforations of the stator shoe as well as of the drum and, consequently, will be beaten.

Also in case the rotor is a drum, the envelope surface of which is at least partly perforated, the inlet opens in the housing outside the drum, the stator shoe is arranged at the inner periphery of the drum and the outlet communicates with the interior of the drum, said object is achieved in that said shield and guide means is arranged between the outlet and the stator shoe to lead beaten suspension directly from the perforations of the stator shoe to the outlet.

BRIEF DESCRIPTION OF THE DRAWINGS

The invention will be described hereinafter with reference to the annexed drawings, wherein FIG. 1 as comparison schematically shows the principle of a beating apparatus having a drum rotor according to the state of art, FIG. 2 in a corresponding manner shows the principle of a beating apparatus having a drum rotor according to a first embodiment of the present invention, FIG. 9 shows a section taken along line IX—IX of FIG. 7 through a stator shoe, FIG. 10 shows a section taken along line X—X of FIG. 7 through a portion of the housing wall and a partition plate.

DETAILED DESCRIPTION OF THE PREFERRED EMBODIMENTS

Figure 1:
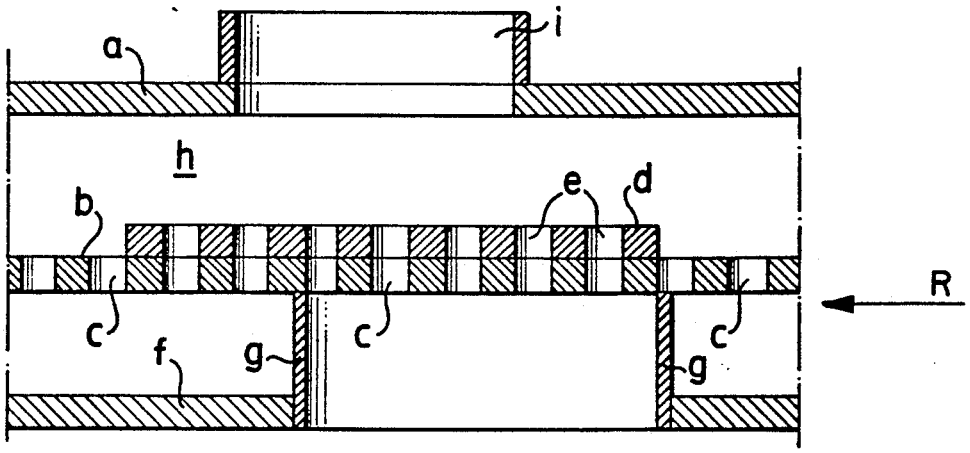

For facilitated understanding of the present invention, reference is made first to FIG. 1, showing with a schematical radial section through a portion of a beating apparatus according to SE-B-307 504 the principle of such a beating apparatus having a drum rotor. In FIG. 1 a is the envelope wall of the housing of the beating apparatus and b is a drum rotatable in the housing and having perforations c. Radially outside the drum there is a stator shoe d having perforations e. A non-shown inlet for suspension leads into the drum, in which there is a shield device f preventing suspension to reach the drum at other locations than where a guide means g is arranged. In practice, at least the envelope wall a, the drum b and the stator shoe d are curved even if they, for the sake of simplicity, are shown here to be straight. The problem with this kind of beating apparatus is that fibres having passed through the perforations c of the drum as well as the perforations e of the stator shoe and which, thus, are beaten, will be mixed with fibres which, due to the rotation of the drum in direction R, do not manage to enter the perforations of the stator shoe but in an unbeaten condition enter the annular space h outside the drum which communicates with the outlet i.

According to the principle of the present invention only beaten suspension shall reach the outlet, i.e., suspension having passed the perforations of the stator shoe.

Figure 2:
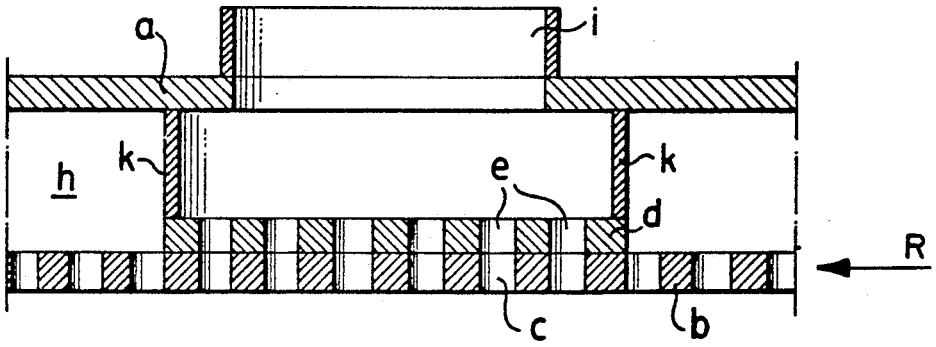
(Prior Art) Fig.2

In FIG. 2, which is drawn in the same schematical way as FIG. 1, is shown how this takes place according to the first embodiment of the present invention, similar details being provided with the same reference letters as in FIG. 1. In the annular space h are arranged means k, which prevent suspension having passed only the perforations c of the drum to reach the outlet i, and which lead beaten suspension from the perforations e of the stator shoe d to the outlet i.

Figure 3:
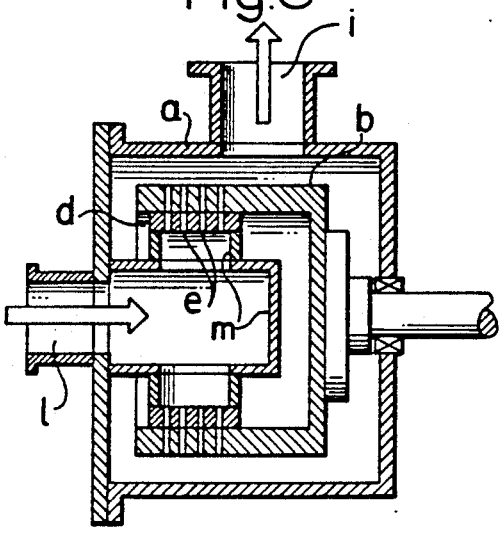
FIG. 3 shows a section through a beating apparatus having a drum rotor according to a second embodiment of the present invention.
Figure 4:
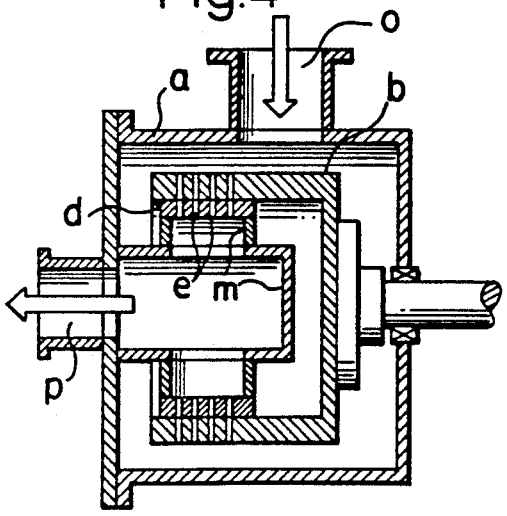
FIG. 4 shows a section through a beating apparatus having a drum rotor according to a third embodiment of the present invention.

In the second embodiment of the present invention according to FIG. 3 and the third embodiment according to FIG. 4, both having drum rotor and being mechanically identical, the stator shoes d are arranged inside the drum b. According to FIG. 3 the flow is positively lead from the inlet l through guide means m, through the perforations e of the stator shoes d and therefrom through the drum b to the outlet i. According to FIG. 4, the flow is counter-directed, suspension from the inlet o being lead to the drum, wherefrom the outlet p can be reached only by passing through the perforations e of the stator shoes located on the inside of the drum and the guide means m.

Practical applications of the three embodiments having drum rotor described above in principle will now be described with reference to FIGS. 5–14. Details common to all embodiments have been given the same reference numeral. 1 denominates a base attachable to a substratum, a shaft 2 being rotatably journalled in said base. The shaft 2 is rotatable by means of a non-shown motor. A beater housing 3 is attached to the base 1. This housing includes a back wall 4, a substantially cylindrical envelope wall 5 and a detachable front wall 6. One end of shaft 2 extends through wall 4 and is sealed by means of sealings 7. The end of shaft 2 extending into housing 3 carries a drum hub 8 keyed to the shaft, at the outer periphery of the drum hub 8 being mounted an exteriorly cylindrical beating drum 9 having substantially radially directed perforations 10. The drum 9 is open in its end turned away from hub 8. The envelope wall 5 of the housing 3 is provided in its lower portion with an opening 11 for removal of solid particles from the housing. The opening 11 is normally closed by a cover 12.

Figure 5:
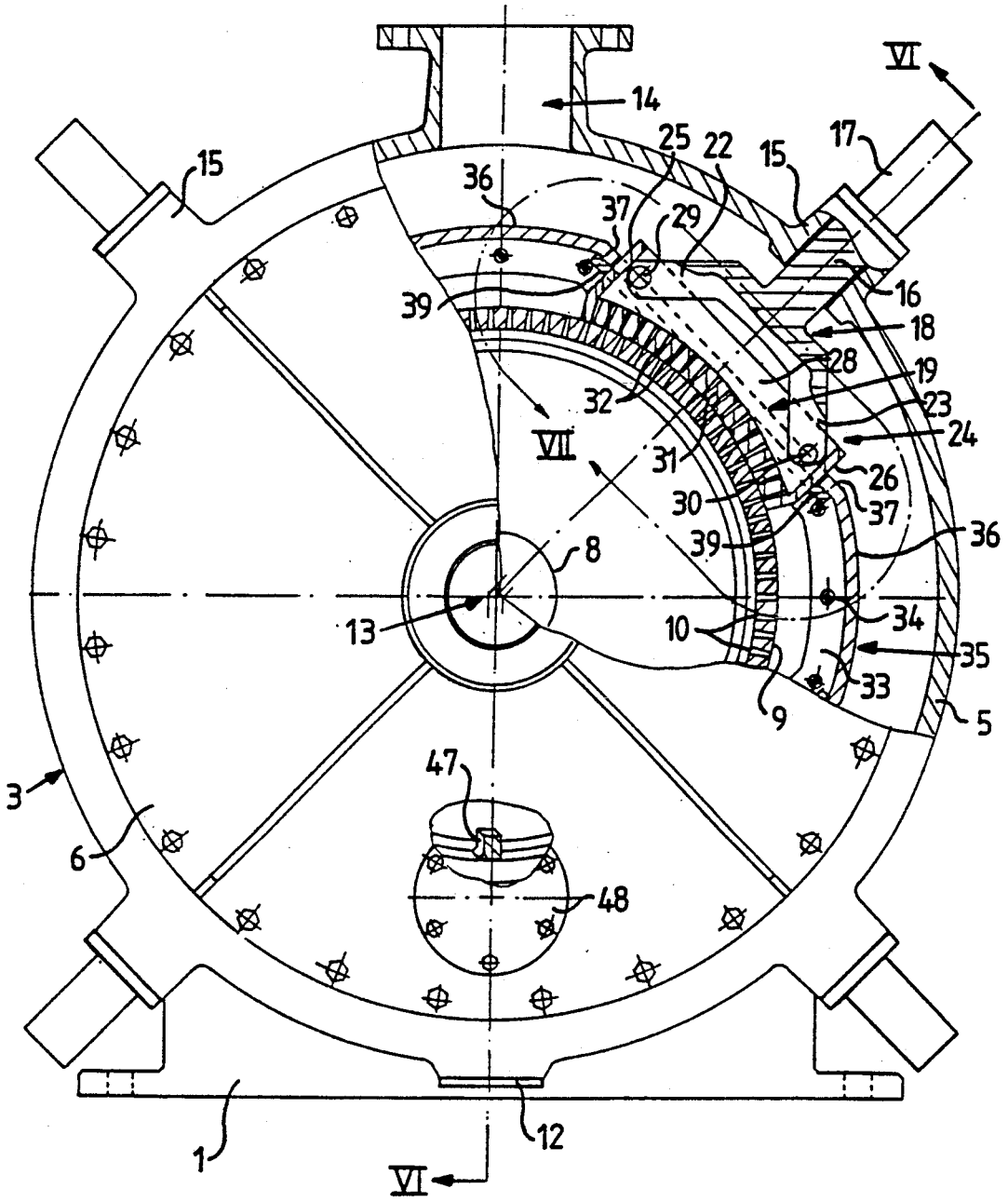
FIG. 5 shows an end view of a practical embodiment of a beating apparatus having a drum rotor according to the first embodiment of the invention, a portion of an end cover being broken away and certain portions of the housing, a stator shoe and a drum being sectioned.
Figure 6:
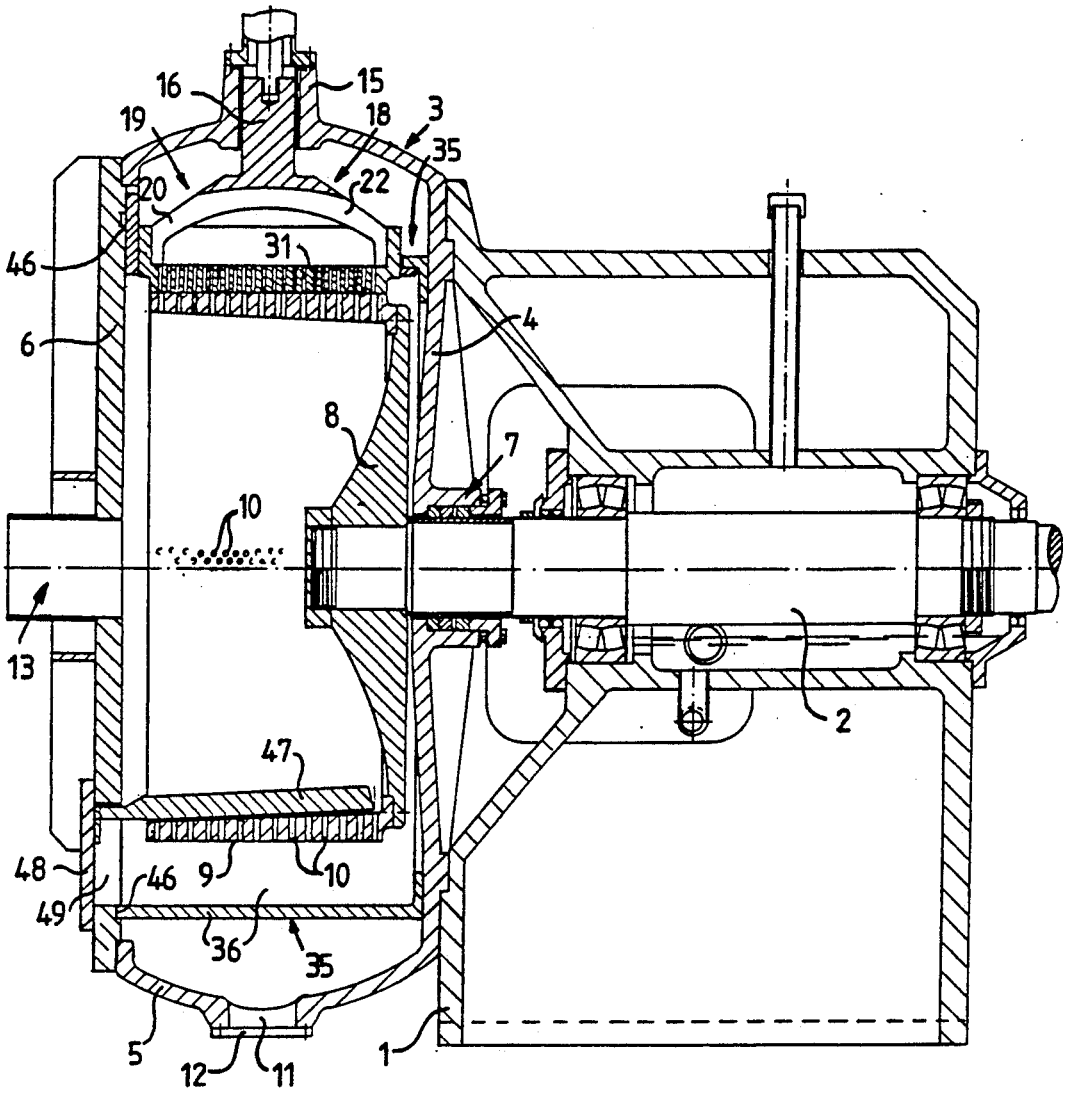
FIG. 6 shows a section taken along line XI—XI of FIG. 5, FIG. 7 at an enlarged scale shows item VII of FIG. 5.
Figure 8:
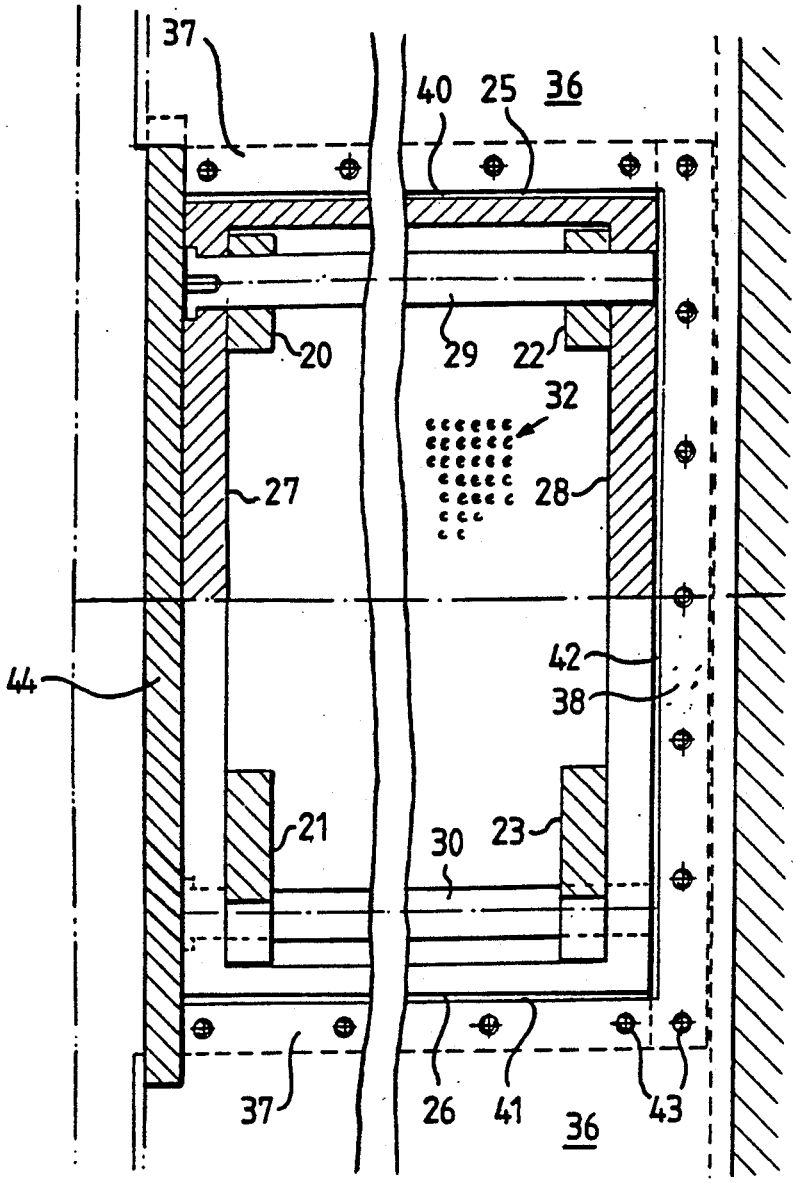
FIG. 8 shows a section taken along line VIII—VIII of FIG. 7 through a stator shoe.

In the first embodiment of the invention shown in FIGS. 5 and 6 the front wall 6 is provided with a central inlet 13 for the fibre suspension or the like to be beaten, and the envelope wall 5 is provided in its upper portion with an outlet 14 for beaten suspension. Radially through thickened portions 15 of the envelope wall 5 extend four piston stems 16 evenly distributed about the circumference, said stems being movable in a radial direction by means of hydraulic cylinders 17 or other power means towards and from the centre of the rotor 9. Each stem 16 is radially inwardly provided with a stator holder 18, carrying a stator 19. The stator holder 18 includes four arms 20, 21, 22, 23, which two by two in the circumferential direction and two by two in the axial direction are fork or yoke like separated, such that the ends of the arms form angles of an imaginary rectangle. The stator 19 includes a radially outwardly open box shaped frame 24 having short walls 25 and 26 and long walls 27 and 28. Through the long walls 27 and 28 and the ends of the arms 20 and 22, and 21 and 23, respectively, located therebetween extend studs 29 and 30 respectively, by means of which the stator frame 24 is carried by the stator holder 18. As an operative part the stator 19 also includes a stator shoe 31, i.e., a curved plate provided with perforations 32 forming the bottom of the box shaped stator frame 24 and having a radially inner curved surface adapted to the outer periphery of the rotor 9. By means of the hydraulic cylinders 17 the stator shoes 31 can be controlled such that their curved surfaces facing the beating rotor 9 are located at a greater or smaller distance from the surface of the beating rotor.

By means of a flange 33 and fastening means 34, such as screws, a shield 35 is liquid tightly attached to the back wall 4 of the beater housing 3, said shield being substantially concentrical to the drum 9 and extending to the front wall 6 of the beater housing 3. In this example the shield 35 includes four cylindrically curved wall portions 36 each being located circumferentially between two adjacent stators 19. More precisely, two curved wall portions 36 located on either sides of the stator terminate with straight portions 37 directed towards each other, said portions in turn terminating some distance from the short walls 25, 26 of the box shaped frame 24 of the stator in question. Between a stator and the back wall 4 a shield 35 extends with a continuous straighte wall portion 38 between two curved wall portions 36. In this area also the flange 33 is straight. The straight wall portion 38 terminates at some distance from the long wall 28 of the stator frame 24 facing the back wall 4. The spaces between the straight wall portions 37 and the short walls 25, 26 of the stator frame and between the continuously straight wall portion 38 and the long wall 28 of the stator frame are slidingly sealed by means of a sealing strip 39 in the shape of a so-called open square having two shorter sides 40 and 41 which are attached to the straight wall portions 37, and one longer side 42 which is attached to the continuously straight wall portion 38. In the example shown the sealing strip 39 is mounted radially inside the wall portions 37 and 38 and is attached thereto by means of screws 43 (FIGS. 7 and 9). Between the long wall 27 of the stator frame and the front wall 6 there is a loose sealing sheet 44 having a substantially greater extension in radial direction than the sides of the sealing strip 39, thereby to better guide the radial movement of the stator frame (FIG. 9). The sealing sheet is kept in place by means of oblique indentations 45 in the ends thereof gripping about portions of the curved wall portions 36 of the shield 35 in the transitional zone to the straight portions 37 (FIG. 7).

Advantageously the curved wall portions 36 of the shield 35 extend into a circular recess 46 provided for that purpose in the front wall 6, in which there may also be provided a non-shown O-ring seal.

From the above description appears that suspension entering the beater housing 3 through inlet 13 has to pass not only the perforations 10 of the beating drum 9 but also the perforations 32 of the stator shoes 31 in order to reach the outlet 14. Suspension passing through the perforations of the drum but not managing to enter the perforations of a stator shoe will indeed leave the drum at its outer periphery but at a location which is separated from the outlet 14 by the shield 35 and more precisely by one of its curved wall portions 36. More precisely expressed, such suspension will be located in a substantially annular space defined by the outer circumference of the drum, one of the curved wall portions of the shield and the facing short walls 26 and 25 of the box shaped frame 24 of two adjacent stators. Due to the rotation of the rotor, suspension will be pumped radially outwards through the perforations of the drum also between the stators and, consequently, there is continuous supply of unbeaten suspension to said space, which, in turn, results in that an excess of unbeaten suspension is returned to the inlet side of the drum. This takes place by flow about the edge of the drum at its open end.

As appears particularly from FIGS. 6 and 9 the exteriorly cylindrical drum has an inner side which conically widens towards its open end. This brings about the advantage that solid material due to centrifugal force will move towards the open end of the drum to fall down between this and a front wall 6 towards the bottom of the beater housing where it can be removed through the cover 12.

In order to clean the inner side of the drum a scraper 47 may be arranged to extend into the drum from the open end thereof. Suitably, such a scraper is attached to a cleaning and inspection cover 48 which closes an opening 49 in the front wall 6.

Figure 11:
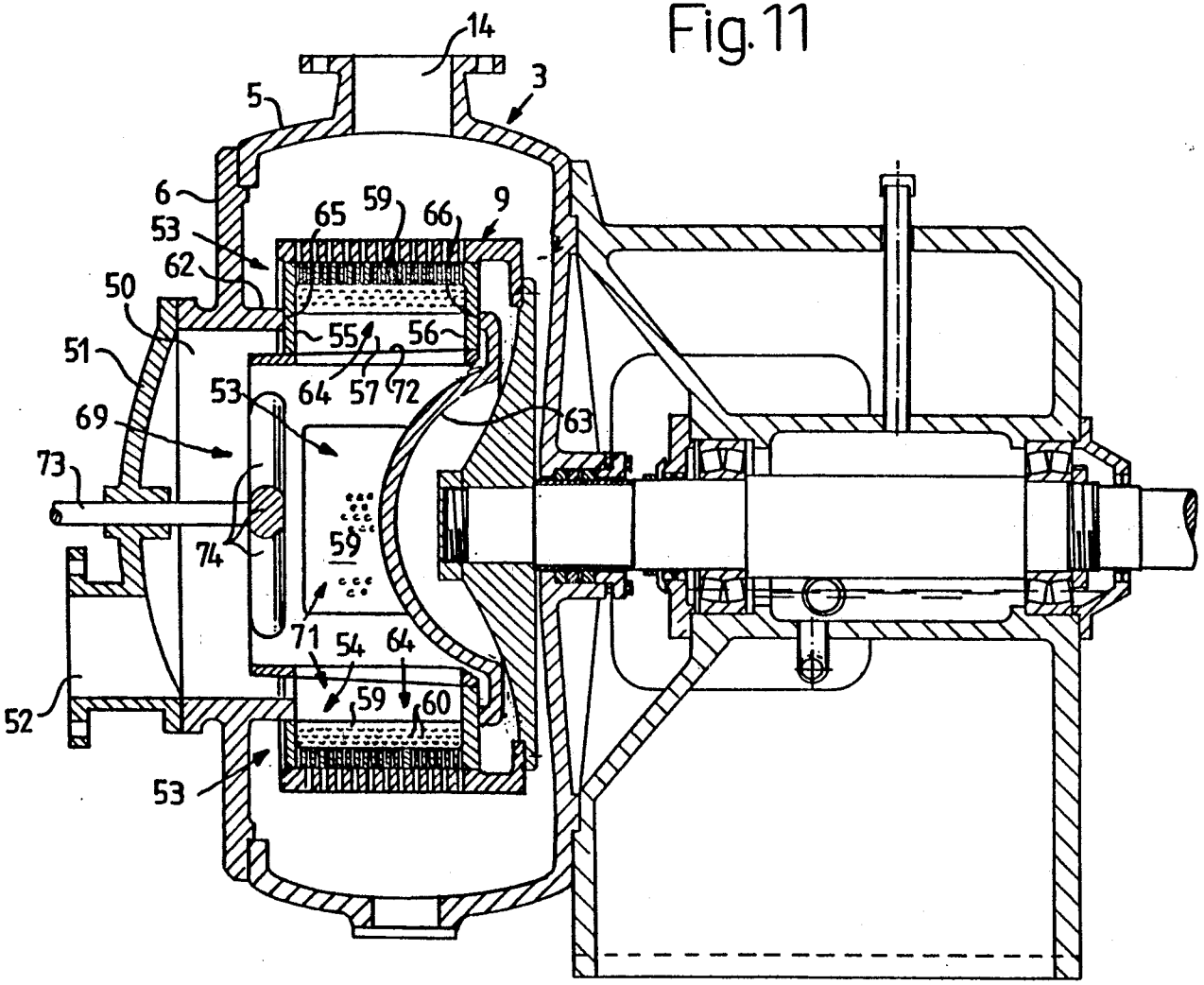
FIG. 11 shows an axial section through a practical embodiment of a beating apparatus having a drum rotor according to the second embodiment of the present invention.
Figure 12:
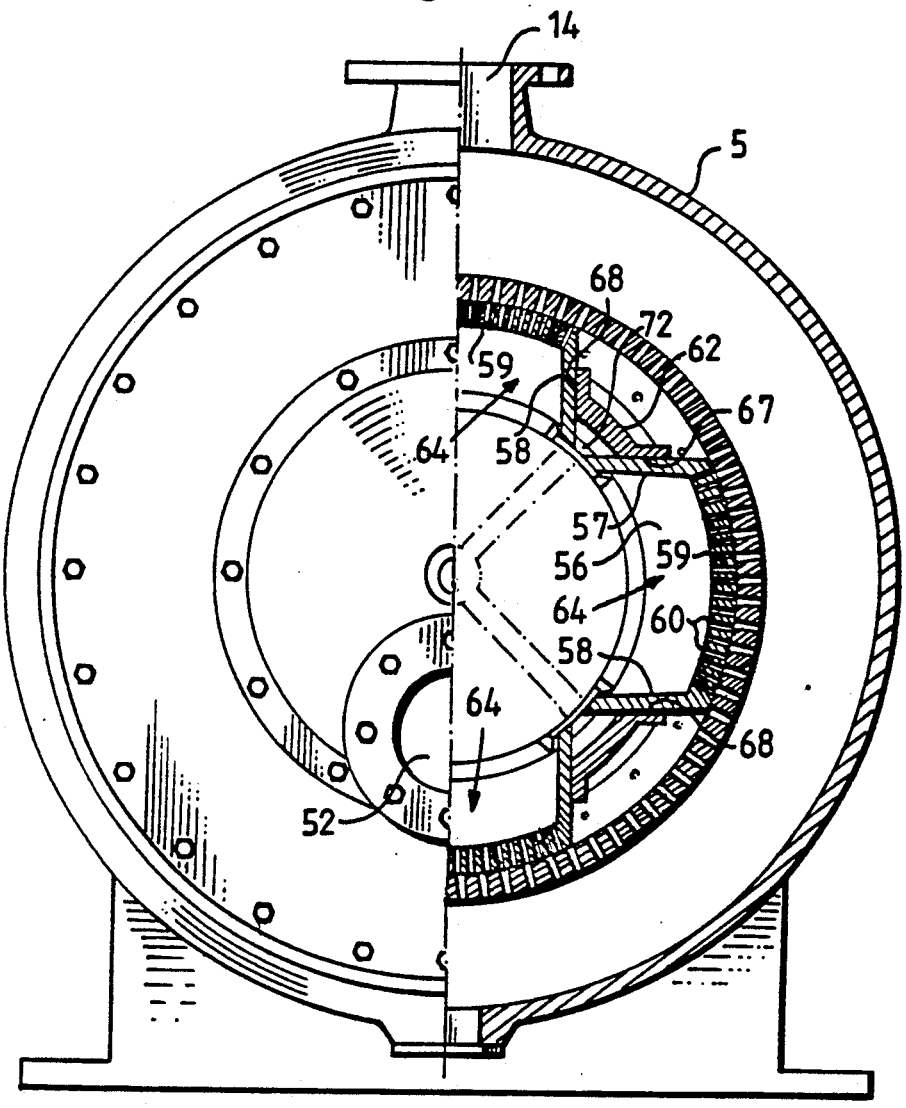
FIG. 12 shows a half broken up end view of the beating apparatus according to FIG. 11, wherein details on the broken up part are shown in section.

In the second embodiment of the present invention shown in FIGS. 11 and 12 the front wall 6 is provided with a relatively large central opening 50, which is closed by a cover 51. On the lower part of the cover 51 there is an inlet 52 for suspension or other material to be beaten. As in the first embodiment of the present invention, the envelope wall 5 of the housing 3 is provided in its upper part with an outlet 14.

As distinguished from the first embodiment, the drum 9 in this embodiment is cylindrical also on the inside, i.e., it has a drum wall of uniform thickness. At the inner circumference of the drum are arranged four stators 53 equally distributed about the circumference, each comprising a box shaped frame 54 being open radially inwards and having axially spaced walls 55 and 56 and circumferentially spaced walls 57 and 58. As an active part a stator has a stator shoe 59, i.e., a curved plate having perforations 60 and forming a bottom of the box shaped frame 54 and further having a radially outer curved surface adapted to the inner cylindrical surface of the drum 9.

Each stator is controlled for movement in a radial direction towards and from the inner circumference of the drum 9. For this purpose the front wall 6 carries a stator cage 61 extending into the drum 9 through the open end thereof and having a substantially cylindrical envelope wall 62 and a bottom 63 which is inwardly curved in order to accommodate the hub 8 on its outside. In the envelope wall 62 there are four openings 64 each axially defined by edges 65 and 66 and circumferentially by radially extended edges 67 and 68. Between these edges of each opening a stator 53 is radially guided. For radial displacement of the stators an axially movable cam device 69 is arranged in the stator cage 61, said cam device basically having the shape of the envelope surface 70 of a truncated cone having its base facing the bottom 63 of the stator cage 61. Opposite to each stator 53 the envelope surface 70 has an opening 71 the dimensions of which is such that the walls 55, 56, 57 and 58 of the stator frames 54 are supported against the envelope surface 70 around the opening. Particularly, one wall 58 of a stator and one wall 57 of an adjacent stator (FIG. 12) shall abut those portions of the envelope surface located between two openings 71 and serving as cam surfaces 72. For cam action between the walls 57, 58 and the cam surfaces 72 also the walls 57, 58 has an inclination adapted to the inclination of the surfaces 72. In order to radially displace the cam device 69 and with it the stators 53, an axially displaceable bar 73 is supported centrally in the cover 51 and in its inner end connected to the inside of the envelope surface 70 by means of four spokes 74. For axial displacement of the bar 73 is arranged non-shown means.

In this second embodiment of the present invention, where the inlet 52 opens in the drum 9, the stator shoes 59 are arranged at the inner circumference of the drum, and the space radially outside the drum communicates with the outlet 14, suspension is lead from the inlet 52 into the cam device 69 and through its openings 71 into the box shaped stators 53. Thus, suspension can reach the outlet 14 only by first having passed through the perforations 60 of the stator shoes 59 and thereafter having been beaten between the stators and the drum 9 to finally pass also the perforations 10 of the drum. Solid particles, such as fibres, which possibly may leave a stator shoe without immediately being brought into a perforation of the drum and which, thus, may enter a space between two stators, the envelope wall 62 of the stator cage and the drum, to a great extent will be lead in between the subsequent stator shoe and the drum, there to undergo a complete beating.

Figure 13:
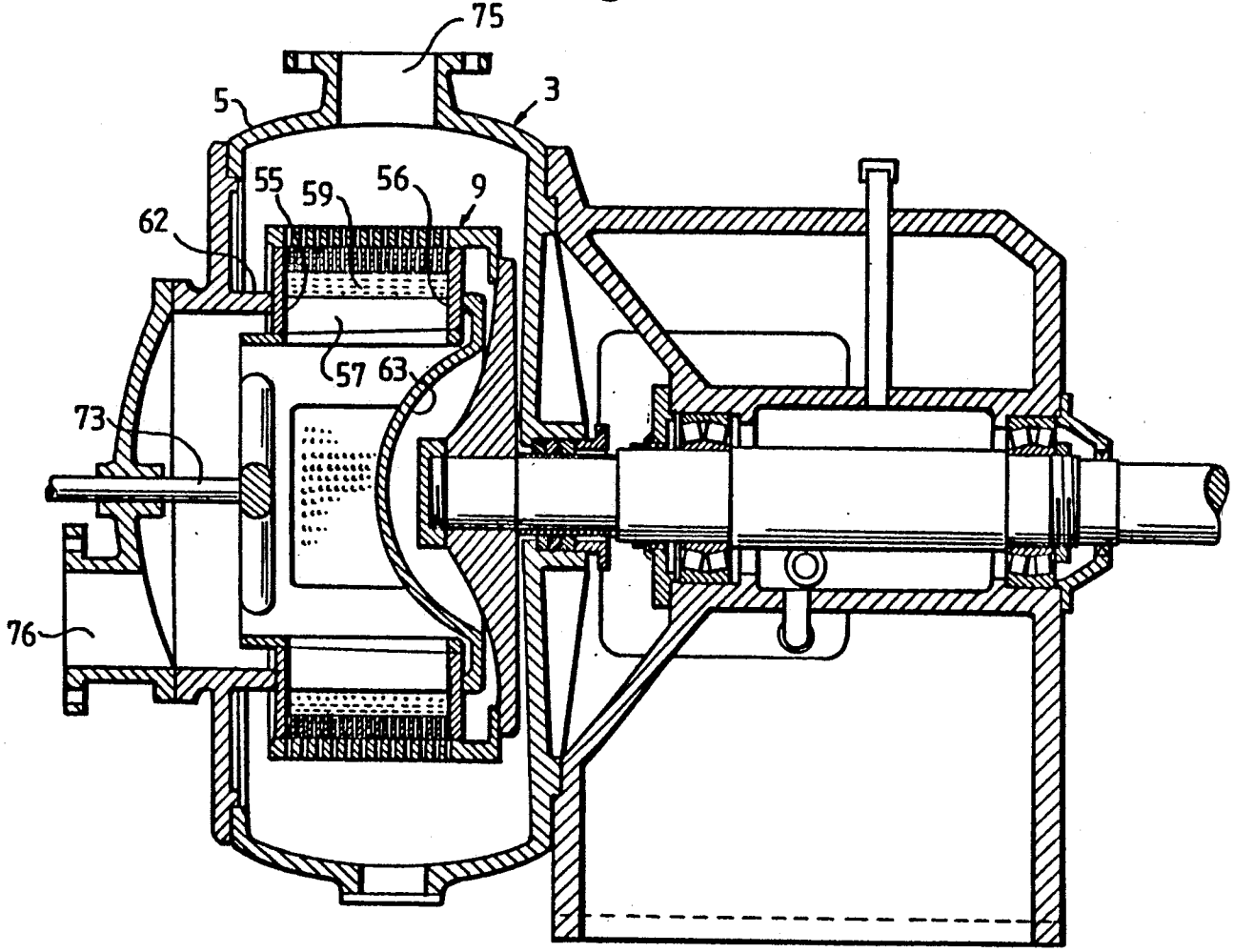
FIG. 13 shows an axial section through a practical embodiment of a beating apparatus having a drum rotor according to the third embodiment of the present invention, which in all essential corresponds to the second embodiment but has a counter-directed flow.
Figure 14:
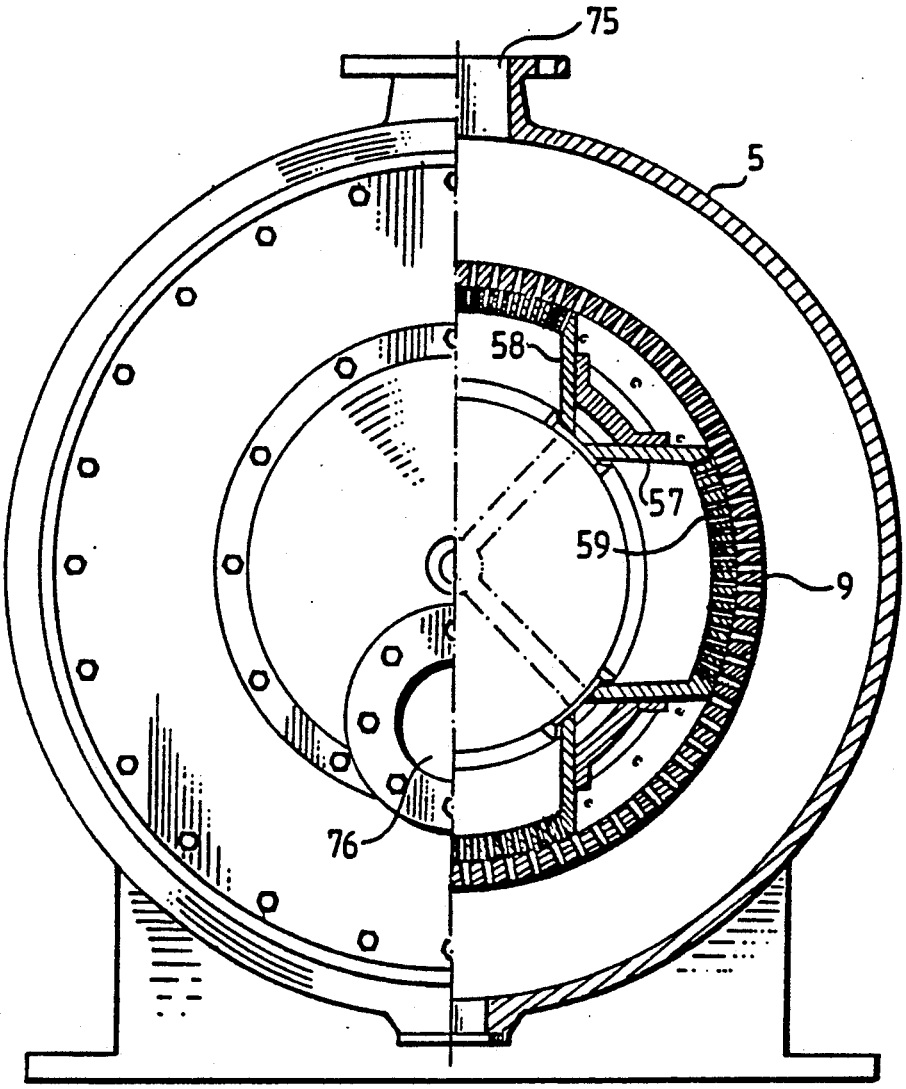
FIG. 14 shows a half broken up end view of the beating apparatus according to FIG. 13, wherein details of the broken up half are shown in section.

The third embodiment of the present invention shown in FIGS. 13 och 14 structurally entirely corresponds to the second embodiment. However, The flow takes place in the opposite direction. Thus, according to FIGS. 11 and 12, the outlet 14 is now inlet 75 and the inlet 52 in this embodiment is outlet 76. From the inlet 75 suspension is lead directly to the outer circumference of the drum 9 and through its perforations radially inwardly through the perforations of the stator shoes 59 to reach the outlet 76 through the interior of the box shaped stator frames 54 and the cam device 69. Unbeaten suspension possibly not managing to leave the perforations of the drum and enter the perforations of a stator during the passage of the drum passed a stator will be thrusted out of the drum during its passage between two stators due to the centrifugal force, this also contributing to prevent clogging of the perforations of the drum.

Figure 15:
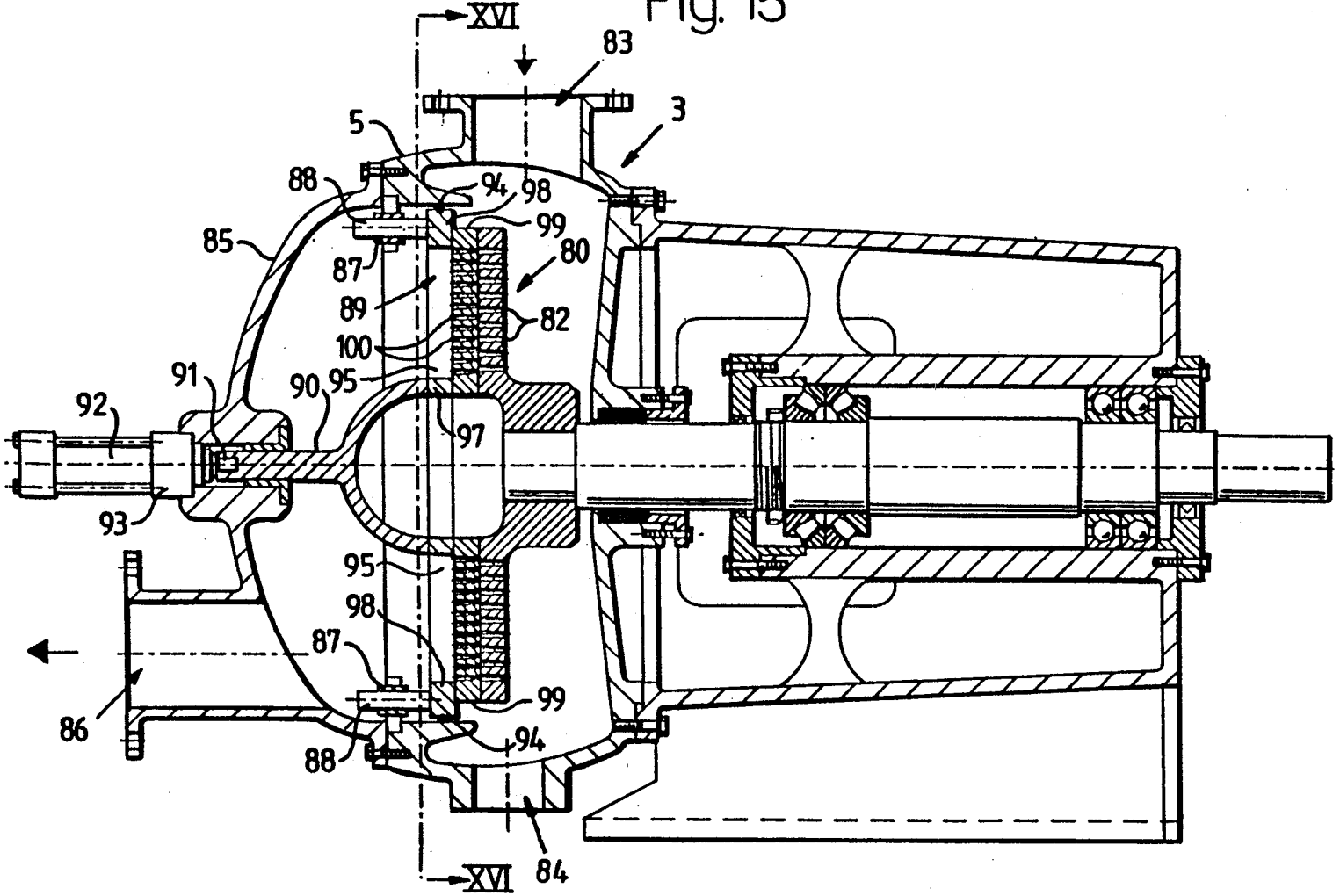
FIG. 15 shows an axial section through a beating apparatus according to the present invention having a disk rotor.
Figure 16:
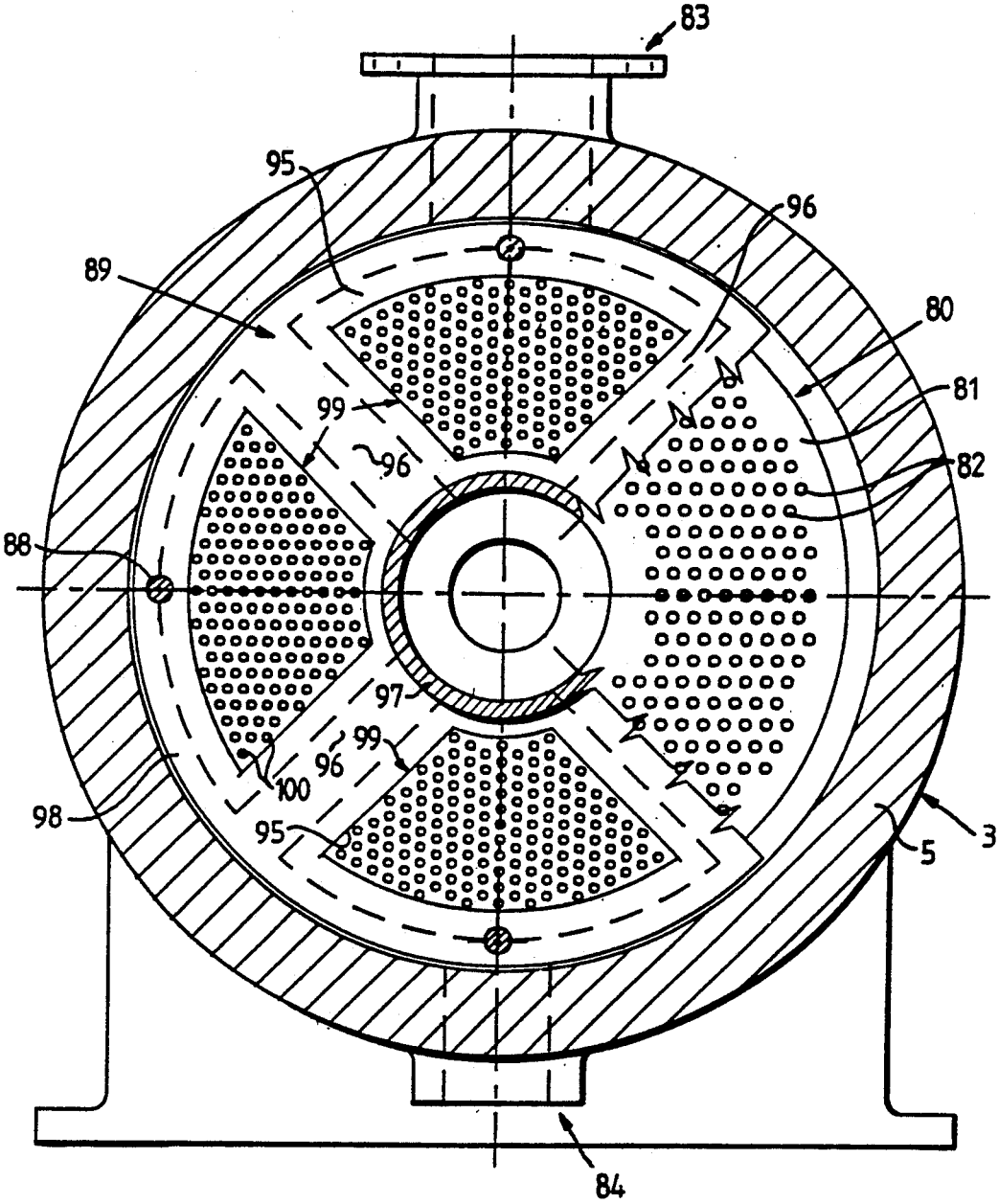
FIG. 16 shows a section taken along line XVI—XVI of FIG. 15.

In the embodiment of a beating apparatus according to the present invention shown in FIGS. 15 and 16, the rotor is a disk rotor 80 rotatably disposed in the housing 3 and having a flat beating surface 81. Perforations 82 extending axially through the disk rotor open in the beating surface 81, the plane of which is perpendicular to the rotational axes. In the upper part of the cylindrical wall 5 of the housing there is an inlet 83 for suspension and in its lower part an outlet 84 for solid particles (reject). The housing is closed by a dome shaped cover 85 attached to the cylindrical wall 5 and provided with an outlet 86 for beaten suspension. On the inside of the circumference of the cylindrical wall there are arranged guide bushings 87 in which guide pins 88 are slidably guided. The guide pins are connected to a circular stator disk 89 which is co-axial to the rotor disk 80 and which, by means of the guide pins 88 and the guide bushings 77, is axially guided in the housing 3 towards and from the rotor disk. The stator disk 89 is centrally carried by an axially directed bar 90 extending through the cover 85 and connected to the piston rod 91 of a hydraulic cylinder 92 the cylinder housing 93 of which is attached to the cover 85. Thus, by means of the hydraulic cylinder 92 the stator disk 89 may be moved towards and from the rotor disk 80. At its outer circumference the rotor disk 80 is slidably sealed against the inner circumference of the cylindrical wall 5 by means of an O-ring 94.

In the example shown, the stator disk 89 is provided with four substantially sector-shaped openings 95 evenly distributed about the circumference. Radial portions 96 of the stator disk extend between these openings like spokes of a wheel from the hub 97 of the disk to its annular circumference 98. On the side of the stator disk 89 facing the rotor disk 80 are arranged sector shaped stator shoes 99 each covering one of the openings 95. The stator shoes have flat beating surfaces facing the beating surface 81 of the rotor disk 80. Perforations 100 extend through the stator shoes.

The stator disk divides the housing 3 in two parts, of which one, in which the rotor in its entirety and the beating surfaces of the stator shoes 99 are located, communicates with the inlet 83, while the other part, in which the surfaces of the stator shoes opposite to the beating surfaces thereof are located, communicates with the outlet 86 through the openings 95. Thus, flow from the inlet 83 to the outlet 86 can take place only through the perforations of the stator shoes, which, in this embodiment as well, results in that only beaten suspension can reach the outlet, while suspension not managing to pass through the perforations of the rotor disk during its passage of a stator shoe not can reach the outlet. Such unbeaten suspension will either remain within the perforations of the rotor disk until they reach the next stator shoe, or, leave the perforations when passing a space between two stator shoes. Since these spaces have the shape of radial channels communicating at the outer circumference of the stator disk with the interior of the housing 3 at the inlet side thereof, this unbeaten suspension will be mixed with unbeaten suspension from the inlet 83.

In this embodiment having a disk rotor, the shield and guide means comprise portions of the stator disk, viz., those radial portions 96 between the stator shoes and the annular outer circumference 98 of the stator disk which is sealed against the inside of the cylindrical wall 5 of the housing 3.

Also the beating apparatus shown in FIGS. 15 and 16 can be operated with reversed flow direction, i.e., such that the outlet 86 is inlet and the inlet 83 is outlet, also in this case flow between the inlet and the outlet taking place only through the stator shoes 99.

I claim:

1. A beating apparatus for fiber suspensions including:

a housing having inlet means for suspension and outlet means for beaten suspension, said inlet means communicating with an inlet compartment of said housing and said inlet means communicating with an outlet compartment of said housing;

a rotatable drum arranged in said housing and having an envelope wall and at one axial end an end wall, said drum being open at its axial end opposed to said end wall, perforations extending between an inner and an outer surface of said envelope wall, one of said surfaces providing a first beating surface;

a plurality of stators circumferentially spaced about said envelope wall in said housing, each of said stators carrying a stator shoe having perforations extending between first and second opposed surfaces thereof, one of said opposed surfaces providing a second beating surface located close to said first beating surface; and shield and guide means arranged between said inlet and said outlet to allow flow from said inlet to said outlet only through said perforations of said stator shoes, wherein said shield and guide means comprises portions of said stators and shield means extending between adjacent stators, said portions of said stators and said shield means together with the stator shoes of said stators providing a partition in said housing dividing it into said inlet compartment and said outlet compartment, the arrangement being such that flow from said inlet and said inlet compartment passing through said perforations of said envelope wall is conducted to said outlet, whereas flow from said outlet and said inlet compartment passing only through said perforations of said stator shoes in returned to said inlet compartment.

2. A beating apparatus according to claim 1, said inlet compartment communicating with said open end of said drum and said stators being located in a space radially outside said outer surface of said envelope wall, wherein said shield means is located in said space to provide said partition together with said portions of said stator shoes.

3. A beating apparatus according to claim 2, wherein portions of said space located between said outer surface of said envelope wall and said shield means communicate with said inlet compartment.

4. A beating apparatus according to claim 1, said inlet compartment being located radially outside said outer surface of said envelope wall and said stators being located radially inside said inner surface of said envelope wall, wherein said shield means is located radially inside said inner surface of said envelope wall to provide said partition together with said portions of said stator shoes.

5. A beating apparatus according to claim 4, wherein said shield means, said portions of said stator shoes and said inner surface of said envelope wall define spaces communicating with said inlet compartment.

* * * * *